US008573749B2

(12) United States Patent
Pan et al.

(10) Patent No.: US 8,573,749 B2
(45) Date of Patent: Nov. 5, 2013

(54) PRINTHEAD FOR GENERATING INK DROPS WITH REDUCED TAILS

(75) Inventors: Alfred I-Tsung Pan, Sunnyvale, CA (US); Erik D. Torniainen, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 137 days.

(21) Appl. No.: 13/266,232

(22) PCT Filed: Apr. 30, 2009

(86) PCT No.: PCT/US2009/042410

§ 371 (c)(1),
(2), (4) Date: Oct. 25, 2011

(87) PCT Pub. No.: WO2010/126520

PCT Pub. Date: Nov. 4, 2010

(65) Prior Publication Data

US 2012/0092421 A1 Apr. 19, 2012

(51) Int. Cl.
*B41J 2/05* (2006.01)

(52) U.S. Cl.
USPC ..... 347/65; 347/61; 347/67

(58) Field of Classification Search
None
See application file for complete search history.

(56) References Cited

U.S. PATENT DOCUMENTS

| | | | | |
|---|---|---|---|---|
| 5,412,413 | A | 5/1995 | Sekiya et al. | |
| 5,872,582 | A | 2/1999 | Pan | |
| 6,003,977 | A | 12/1999 | Weber et al. | |
| 6,299,270 | B1 | 10/2001 | Merrill | |
| 6,412,913 | B1 | 7/2002 | Moon et al. | |
| 6,491,364 | B2 | 12/2002 | Webster et al. | |
| 6,557,974 | B1 | 5/2003 | Weber | |
| 6,561,631 | B2 | 5/2003 | Shin et al. | |
| 7,377,624 | B2 * | 5/2008 | Park et al. | 347/56 |

FOREIGN PATENT DOCUMENTS

| | | |
|---|---|---|
| JP | 1994-071887 | 3/1994 |
| JP | 1998-181021 | 7/1998 |
| JP | 2006-007780 | 1/2006 |
| KR | 1020020026076 | 4/2002 |
| KR | 1020050122897 | 12/2005 |

OTHER PUBLICATIONS

PCT Search Report for WO 2010126520, dated Nov. 27, 2009.

* cited by examiner

*Primary Examiner* — Geoffrey Mruk

(57) ABSTRACT

A printhead (10) for use in an inkjet printing process includes a substrate (12) having at least one ink feed opening (14) defined therein, an ink chamber (16) in operative and fluid communication with the ink feed opening(s) (14), and a nozzle plate (18) disposed on a portion ($P_1$) of the substrate (12). The nozzle plate (18) has a plurality of orifices (20) defined therein. The printhead (10) further includes a firing resistor (22) disposed on another portion ($P_2$) of the substrate (12) and proximate to the ink feed opening(s) (14) and a barrier structure (24) disposed on the other portion ($P_2$) of the substrate (12) and positioned adjacent to the firing resistor (22).

14 Claims, 6 Drawing Sheets

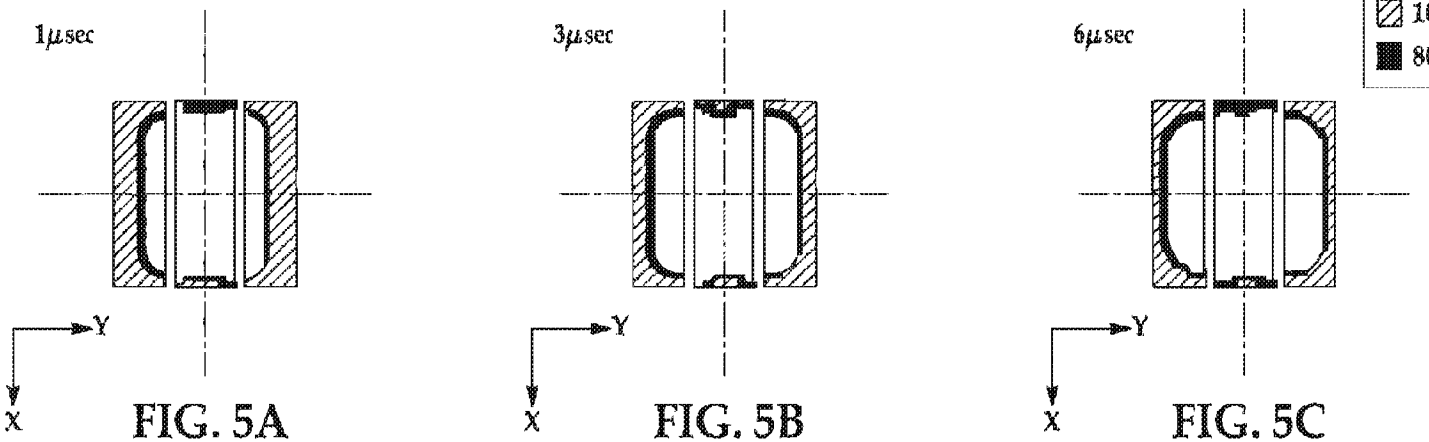
FIG. 5A
FIG. 5B
FIG. 5C
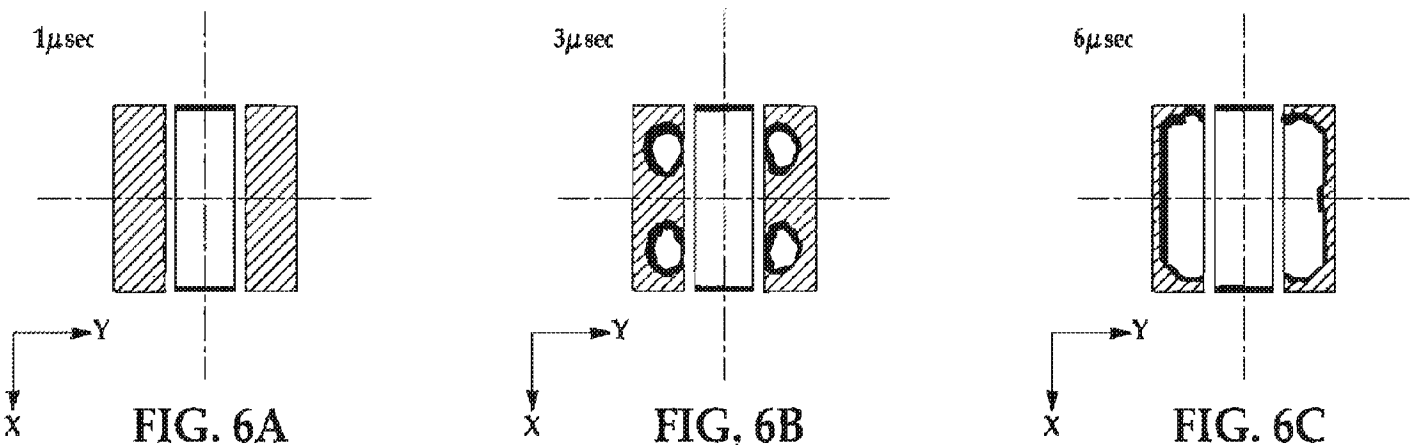
FIG. 6A
FIG. 6B
FIG. 6C

PRINTHEAD FOR GENERATING INK DROPS WITH REDUCED TAILS

BACKGROUND

The present disclosure relates generally to a printhead for generating ink drops having reduced tails.

Inkjet printing is a digital printing method for forming images on a print media. Several different inkjet printing methods are known, one of which includes thermal inkjet printing. In thermal inkjet printing, an ink drop may be ejected onto the print media by superheating a volume of fluid inside a printhead. The superheated volume of fluid thereby generates an ink bubble, which rapidly expands during the superheating. During such expansion, the ink bubble reaches an ejection pressure, whereby an ink drop is ejected from the printhead and is deposited onto the print media.

BRIEF DESCRIPTION OF THE DRAWINGS

Features and advantages of embodiment(s) of the present disclosure will become apparent by reference to the following detailed description and drawings, in which like reference numerals correspond to the same or similar, though perhaps not identical components. For the sake of brevity, reference numerals having a previously described function may or may not be described in connection with subsequent drawings in which they appear.

FIGS. 5A through 5C are snap shots schematically showing an altering of a profile of a bubble pressure of a printhead without a barrier structure during an ejection process;

FIGS. 6A through 6C are snap shots schematically showing an altering of a profile of a bubble pressure during an ejection process, in conjunction with an embodiment of the printhead as disclosed herein, with a barrier structure having a height of 5 μm;

DETAILED DESCRIPTION

Embodiment(s) of the printhead as disclosed herein include a barrier structure that advantageously achieves a balance between an ink refill rate and blow back. In particular, the printhead disclosed herein (when compared to similar printhead architectures without the barrier structure) reduces blow back while generally increasing the refill rate.

Figure 1:
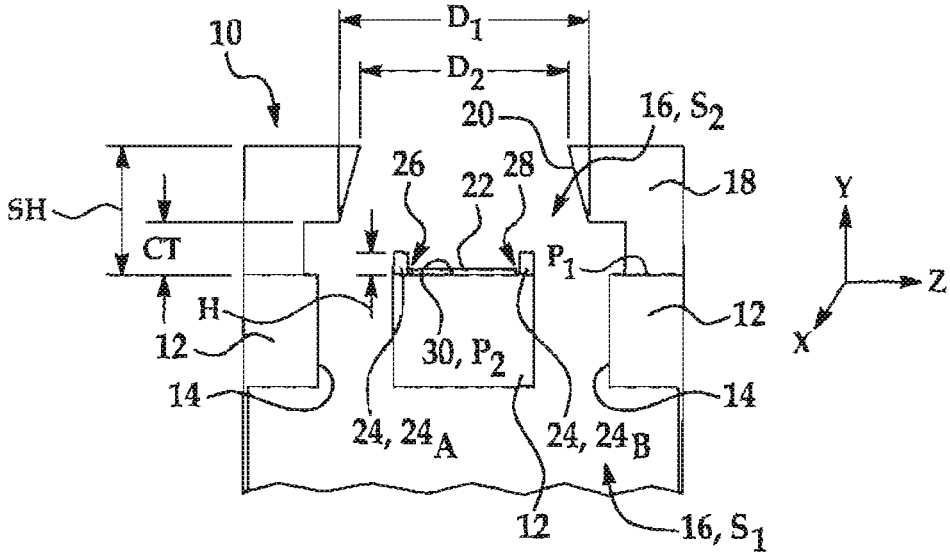
FIG. 1 is a cross-sectional, schematic view of a portion of a printhead according to an embodiment disclosed herein.

An embodiment of a portion of a printhead 10 for use in an inkjet printing process is schematically shown in FIG. 1. The printhead 10 generally includes a substrate 12 (made, e.g., from silicon or another suitable material) having at least one ink feed opening 14 defined therein. Two ink feed openings 14 are shown in FIG. 1, though it is to be understood that any desirable number of ink feed openings 14 may be provided. The ink feed opening 14 is in operative and fluid communication with an ink chamber 16.

The ink chamber 16 is split into two sections; a section $S_1$ below a firing resistor 22 (described in detail below) and a section $S_2$ above the firing resistor 22. The ink feed opening(s) 14 supply ink from section $S_1$ to section $S_2$. The ink chamber 16 is generally configured to repeatedly receive ink from an ink supply or source during inkjet printing. In one example, the printhead 10 may be incorporated with an ink cartridge, and the ink chamber 16 receives the ink from one or more ink supply regions housing, e.g., a volume of free ink and/or a capillary media configured to store the ink in individual capillaries. In another example, the printhead 10 may be a separate unit operatively connected (via appropriate tubing or the like) to a remotely located ink supply. Other configurations of the printhead 10 with respect to an ink supply are also contemplated herein.

The printhead 10 further includes a nozzle plate 18 disposed on a portion $P_1$ of the substrate 12. In a non-limiting example, the nozzle plate 18 includes a plurality of orifices 20 (one of which is shown in FIG. 1), where each orifice 20 has an entrance diameter $D_1$ and an exit diameter $D_2$. The orifice 20 is generally in fluid communication with the ink chamber 16 and is configured to eject an ink drop therethrough during an ink ejection process (i.e., the pushing of the ink out of the printhead 10 through the orifice 20 during inkjet printing).

The firing resistor 22 is disposed on another portion $P_2$ of the substrate 12 and proximate to the ink feed opening(s) 14. The firing resistor 22 is also operatively associated with the orifice 20. Although FIG. 1 depicts that the firing resistor 22 is operatively associated with a single orifice 20, it is to be understood that the firing resistor 22 may also be operatively associated with a plurality of orifices.

Figure 3C:
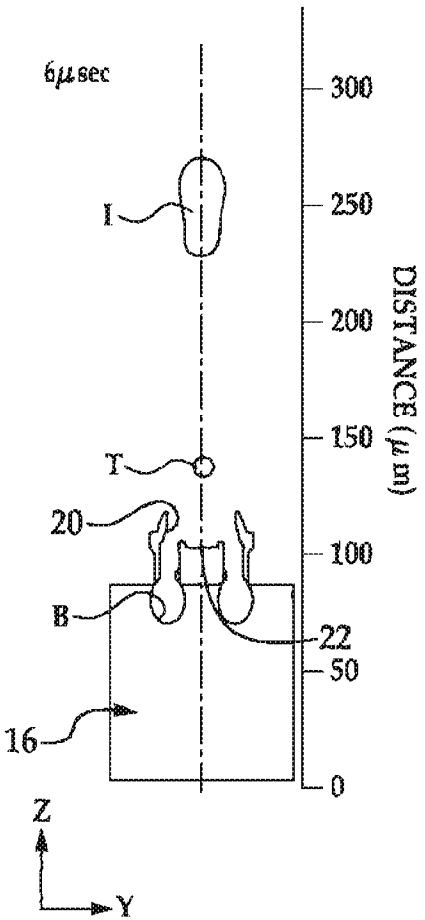
FIGS. 3A through 3C are snap shots schematically showing an ink ejection process using a printhead without a barrier structure.
Figure 3B:
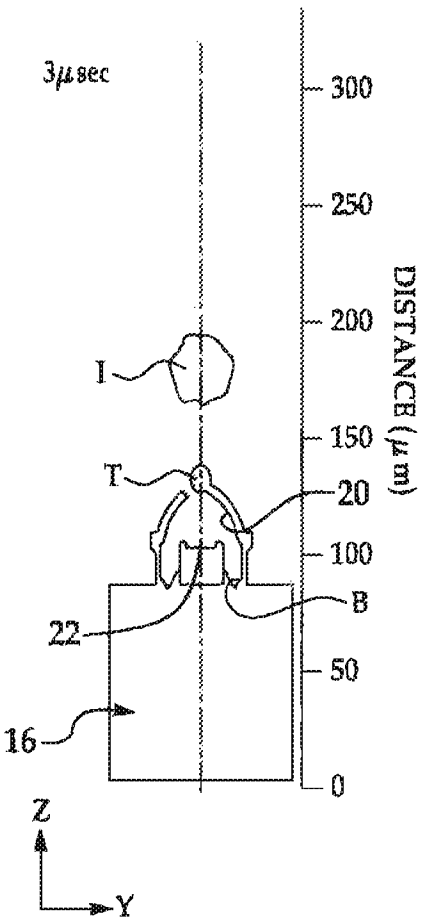
Figure 3A:
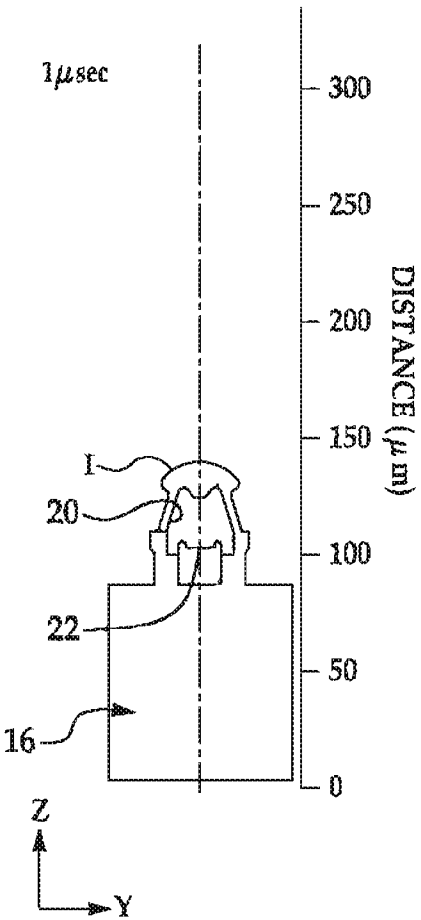

FIGS. 3A through 3C is a series of snap shots (taken at 1 μsec, 3 μsec, and 6 μsec, respectively) schematically showing an ink ejection process using a known printhead. During printing, a volume of the ink is delivered from the ink supply (not shown) to the ink chamber 16. Inside the ink chamber 16, the firing resistor 22 locally heats the ink and vaporizes a portion of it. The vaporized portion of the ink ultimately forms an ink bubble in the section $S_2$ of the ink chamber 16. As the ink bubble expands inside the ink chamber 16, the pressure therein (i.e. the bubble pressure) decreases until the ink bubble reaches a pressure at which it i) vents out of the orifice 20, or ii) becomes lower than atmospheric pressure and collapses. Just before the ink bubble vents or collapses, at least a portion of the ink inside the ink chamber 16 is pushed out of the orifice 20 of the nozzle plate 18 in the form of an ink drop I (shown in FIG. 3A). The pressure at which the ink drop I is ejected from the printhead 10 is referred to herein as the "ejection pressure".

During ink ejection, all of the ink in the section $S_2$ of the ink chamber 16 may be pushed out of the orifice 20 when an ink drop is ejected. Such fluid ejection is often referred to as "clear mode thermal ejection," and in many instances produces ink drops having significantly reduced tails or, in some cases, ink drops that are substantially tail-free. In a non-limiting example, an ink drop having a reduced tail includes at least about 90% of the ink ejection actually contained in the ink drop. As used herein, a "tail-free fluid drop" or a "substantially tail-free fluid drop" is a fluid drop that does not have a tail, i.e., a secondary fluid drop that is smaller than the primary fluid drop and follows the primary fluid drop when ejected. Tails are often separated from the primary fluid drop before contacting a print media, forming satellites around the primary fluid drop. It is to be understood that the ink drops, although substantially tail-free, may still produce satellites due, at least in part, to capillary ink ligaments attached to the nozzle plate 18. Instances where the satellites are formed while the ink bubble is vented out of the orifice 20 may be referred to as a transitional mode.

In another example, a portion of the ink located in the section $S_2$ of the ink chamber 16 may be pushed out of the orifice 20. Such a fluid ejection process often forms ink drops I having tails T (as shown in the FIG. 3 series).

Still referring to the FIG. 3 series, after the ink drop I has been ejected from the printhead 10, the ink bubble continues to expand until it vents or collapses. The expanding bubble also pushes the ink into section $S_2$ of the ink chamber 16, back toward the ink supply. Such drawing of the ink back toward the ink supply is known as "blow back". As shown in FIGS. 3A through 3C, the blow back B increases over time (e.g., over about 5 μsec) as the ink drop I and the tail T (if any) are ejected from the printhead 10.

It is to be understood that after an ink drop has been ejected, it may be necessary to refill a void formed in section $S_1$ of the ink chamber 16 because of i) the ejecting of the ink, and ii) a blow back of ink in section $S_2$. The rate of refilling the ink chamber 16 is referred to herein as the "refill rate" and may, in some instances, be used to describe the efficiency of the printhead 10. However, it is also to be understood that in some cases, a large blow back (such as, e.g., about 40 pL) may adversely affect the refill rate, thereby affecting the operating efficiency of the printhead 10. It is yet further to be understood that energy stored in the ink chamber 16 created by the blow back may also affect the refill rate of the ink chamber 16. For example, as the bubble pushes the ink back into the ink chamber 16, the ink chamber 16 is actually being compressed. As such, similar to a spring, the chamber 16 will spring back at the same rate of its compression due to this stored energy. Accordingly, a controlled blow back is desirable to achieve a suitably, efficiently operating printhead 10. Balancing the amount of blow back with the refill rate is discussed further below.

Without being bound to any theory, it is believed that by altering a profile or configuration of the bubble pressure of the printhead 10, the blow back of the ink may be significantly reduced after forming an ink drop I. It is further believed that such reduction generally increases (or in some cases, at least maintains) the refill rate of ink chamber 16 after ejection, thereby substantially increasing the operating or firing efficiency of the printhead 10. Accordingly, embodiment(s) of the printhead 10 as disclosed herein are advantageously constructed in a manner sufficient to suitably alter the profile of the bubble pressure. Further, such altered profile of the bubble pressure enables the formation of ink drops having reduced tails or, in some cases, the formation of substantially tail-free ink drops during the ejection process.

Figure 2:
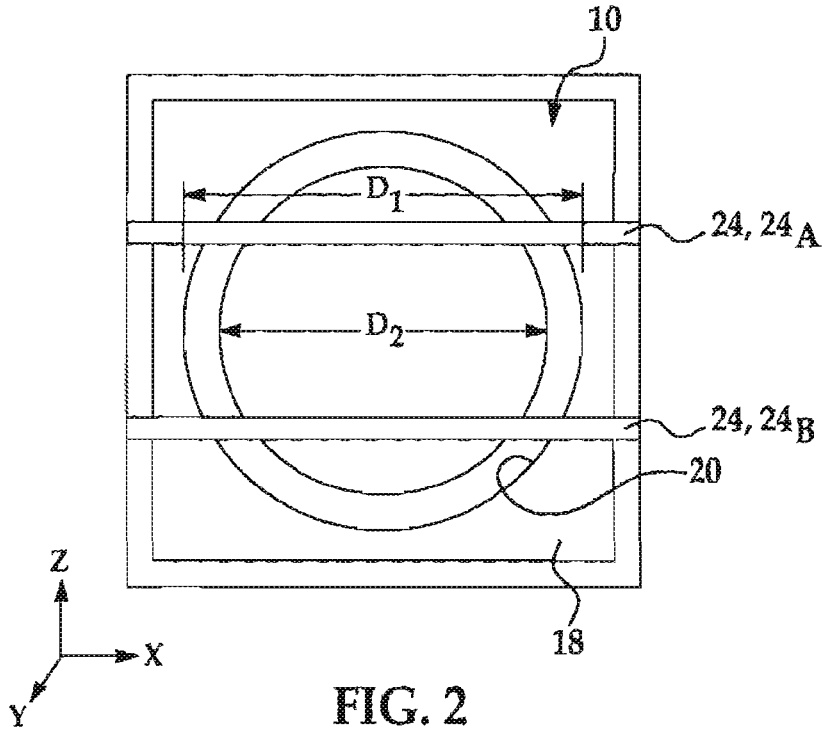
FIG. 2 is a plan view of the portion of the printhead shown in FIG. 1.

The inventors of the instant disclosure have also unexpectedly and fortuitously determined that the altering of the profile of the bubble pressure may be accomplished by disposing a barrier structure 24 on the portion $P_2$ of the substrate 12, positioned adjacent to the firing resistor 22. An embodiment of the barrier structure 24 is shown in FIGS. 1 and 2. In an example, the barrier structure 24 acts like a darn inside the printhead 10 that diverts most of the bubble pressure (and thus, the ink volume) toward the orifice 20 of the nozzle plate 18. The pressure that is diverted toward the orifice 20 suitable drives the ink drop out of the printhead 10 and onto a print media or surface. Further, the barrier structure 24 reduces pressure back toward the ink supply at the beginning of the bubble expansion when the bubble pressure is at its peak, until the bubble grows past the barrier height when the pressure inside the expanding bubble is reduced. The diverted pressure suitably draws (or blows) the non-ejected ink back toward the ink supply. The amount of pressure needed to cause the blow back of the ink may be any pressure sufficient to overcome capillary pressure of the ink supply. In a non-limiting example, the amount of pressure needed to cause blow back ranges from about 1 atm to about 50 atm. In another non-limiting example, the amount of pressure needed to cause blow back of the fluid ranges from about 1.5 atm to about 2.0 atm. Optimization of such blow back is desirable so that the ink chamber 16 may thereafter be refilled for subsequent ink drop ejection at a suitable refill rate. In a non-limiting example, the suitable refill frequency for subsequent ink drop ejection is greater than about 24 kHz.

It is still further believed that both the positioning and the geometry of the barrier structure 24 also affect the altering of the profile of the bubble pressure. Still referring to FIGS. 1 and 2, in an embodiment, the barrier structure 24 includes a pair of substantially parallel barrier strips $\mathbf{24}_A$ and $\mathbf{24}_B$, each formed as a solid, continuous structure. The barrier strips $\mathbf{24}_A$, $\mathbf{24}_B$ extend substantially perpendicularly outwardly from the substrate 12 (e.g., in a y-direction) on respective opposed sides 26, 28 of the firing resistor 22 (e.g., in an x-direction). As shown in the embodiment depicted in FIGS. 1 and 2, one of the barrier strips $\mathbf{24}_A$ is disposed adjacent to one side 26 of the firing resistor 22, and the other of the barrier strips $\mathbf{24}_B$ is disposed adjacent to the opposed side 28 of the firing resistor 22. It is to be understood, however, that other constructions of the barrier structure 24 that suitably divert an appropriate amount of the bubble pressure toward the orifice 20 of the nozzle plate 18 and reduce pressure toward the ink supply are also contemplated herein. In a non-limiting example, the barrier structure 24 may be circular shaped, oval shaped, square shaped, rectangular shaped, fractal shaped, or the like. With such geometry, the barrier structure 24 is still disposed on the substrate 12, but is positioned in a manner sufficient to actually surround the firing resistor 2.

Using any of the constructions of the barrier structure 24 described hereinabove, when an ink drop is formed, the barrier structure 24 confines the expanding or growing ink bubble therein. If the barrier structure is a pair of barrier strips $\mathbf{24}_A$, $\mathbf{24}_B$ (as shown in FIGS. 1 and 2), the ink bubble is confined between the strips. When the bubble vents or collapses, the barrier strips $\mathbf{24}_A$, $\mathbf{24}_B$ (or barrier structure 24) confining the bubble substantially prevent/s the bubble pressure from being directed in any direction except toward the orifice 20 or back toward the ink supply. In other words, the bubble pressure is directed in a direction other than sideways with respect to the barrier strips $\mathbf{24}_A$, $\mathbf{24}_B$.

Figure 4C:
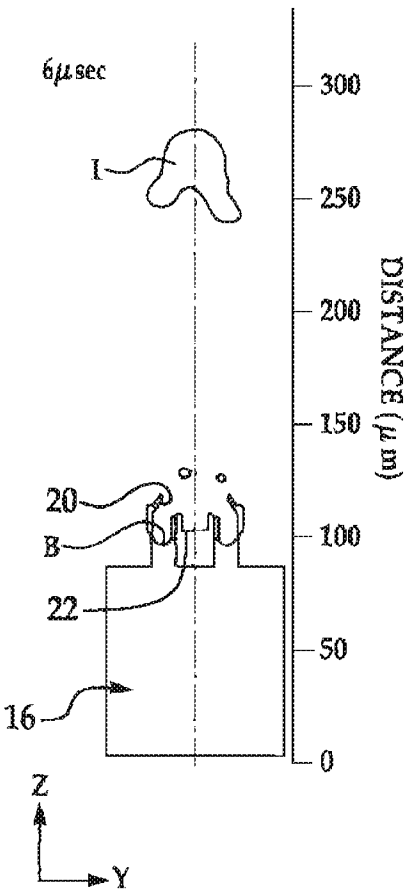
FIGS. 4A through 4C are snap shots schematically showing an ejection process using an embodiment of the printhead as disclosed herein, with a barrier structure having a height of 5 μm.
Figure 4B:
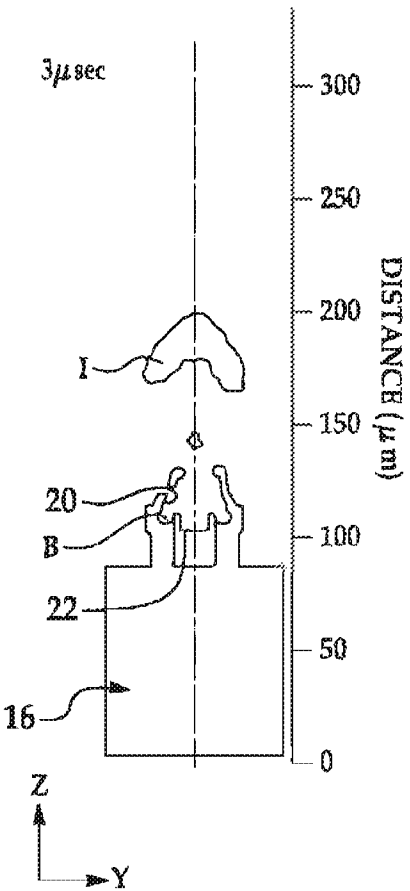
Figure 4A:
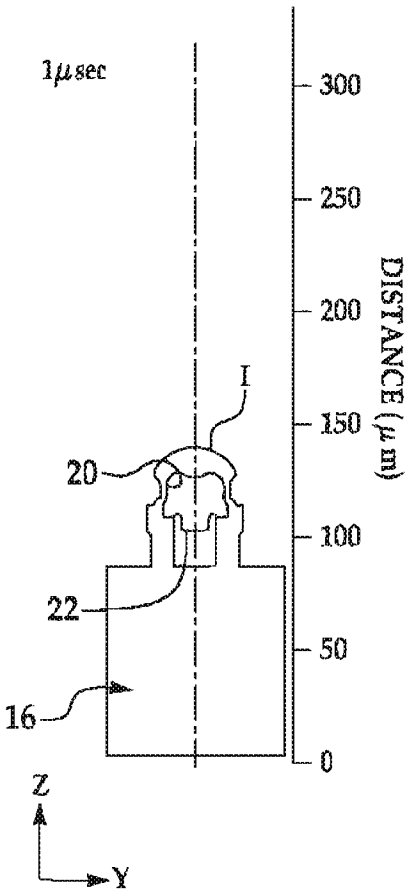
Figure 7:
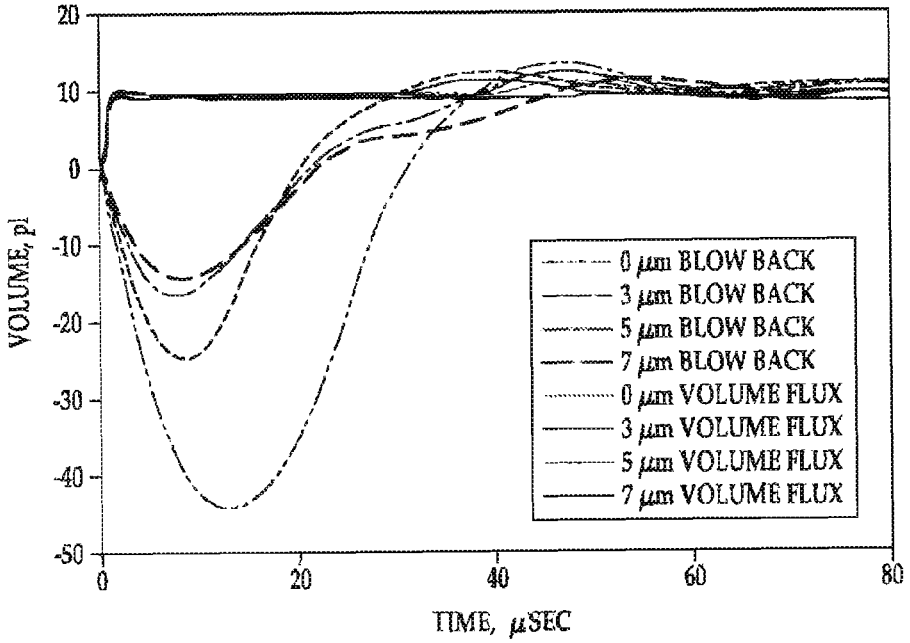
FIG. 7 is a graph showing the effect of the height of a barrier structure on blow back of the ink and a refill rate of the printhead.

FIGS. 4A through 4C is a series of snap shots (taken at 1 μsec, 3 μsec, and 6 μsec, respectively) schematically showing an ink ejection process using an embodiment of the printhead 10, e.g., as shown in FIGS. 1 and 2. In this example, the printhead 10 includes a barrier structure 24 having a height of about 5 μm. In contrast to the printhead of the FIG. 3 series, when the ink drop I is ejected using the printhead 10 according to embodiment(s) of the instant disclosure, the blow back B is significantly reduced (e.g., by about 20 pL or so (as shown in FIG. 7)). Furthermore, the ink drop I of FIG. 40 is formed without a tail T or secondary ink drop.

The FIG. 5 series and the FIG. 6 series depict snap shots of a plan view of the printhead that does not include a barrier, and a printhead 10 according to an embodiment of the instant disclosure, respectively. In the FIG. 6 series, a barrier structure having a height of 5 μm was used. As shown in the FIG. 5 series, the pressure of the bubble that travels through the ink feed opening(s) 14 changes minimally during ejection of the ink drop I (from 1 μsec to 6 μsec). In an example, the pressure of the bubble of most of the area of the ink chamber is about 800 kPa, showing a spreading of the bubble pressure across the ink chamber.

On the other hand, the printhead 10 including the barrier structure 24 alters the profile of the bubble pressure during ejection in order to reduce the blow back. For example, as shown in FIG. 6B, the bubble pressure much of the ink chamber 16 is about 100 kPa (shown cross hatched), while the bubble pressure at other areas (shown dark) of the ink chamber 16 is about 800 kPa, showing that the pressure at the other areas has been diverted toward the orifice 20.

In the embodiment of the barrier structure 24 shown in FIGS. 1 and 2, the barrier strips $\mathbf{24}_A$, $\mathbf{24}_B$ also each have a height H that extends outwardly from a surface 30 of the substrate 12. The inventors of the instant disclosure have further discovered that the height H of the barrier structure 24 also affects the altering of the profile of the bubble pressure so that most of the pressure is diverted in a direction toward the orifice 22. A graph showing the effect of the height H on blow back and on the refill rate is shown in FIG. 7 for printheads including i) no barrier structure, ii) a 3 μm tall barrier structure, iii) a 5 μm tall barrier structure, and iv) a 7 μm tall barrier structure. When the ink bubble vents (which occurs between about 10 microseconds and about 15 microseconds), the blow back of the printhead 10 including the 3 μm tall barrier structure is about 25 pL, which is significantly smaller than that of the printhead that does not include a barrier structure (which is about 45 pL or more). The blow back of the printhead 10 also reduces as the barrier structure increases in height H. For example, the blow back in the printhead 10 including the 5 μm tall barrier structure is about 15 pL, while the blow back in the printhead 10 including the 7 μm tall barrier structure is about 14 pL. In a non-limiting example, the blow back in the printhead 10 including a barrier structure 24 ranges from about 10 pL to about 30 pL, which is significantly reduced from that of a printhead having no barrier structure. It is to be understood, however, that the blow back may differ based, at least in part, on the drop weight of the printhead 10 architecture. It is further to be understood that the drop weight of the printhead 10 architecture is also a function of the size of the resistor 22.

It is to be understood, however, that although the taller barrier structure (e.g., the 7 μm tall barrier structure) tends to reduce blow back, such taller structures may deleteriously affect the refill rate of the ink chamber 16 for subsequent ink drop ejection. Such deleterious effect may be due, at least in part, to the fact that there is more structure height that the ink has to cross in order to properly refill the ink chamber 16 for a given time period. Such effect may also be due, at least in part, to a smaller opening formed between the top of the taller barrier structure and an inner surface of the orifice 20 that the ink has to fit through in order to fill up the ink chamber 16. Further, the rate of the blow back (due to, e.g., the energy stored in the ink chamber 16 causing its compression) also affects the refill rate. As shown in FIG. 7, the 3 μm tall barrier structure reaches its highest blow back at almost the same time as the 5 μm tall and the 7 μm tall barrier structures. The blow back rate (identified by the slope of the lines shown in FIG. 7) also enables the printhead 10 having the 3 μm tall barrier structure to refill at a higher rate than for the printheads 10 including the 5 μm tall and the 7 μm tall barrier structures. Accordingly, the selection of the height H is generally accomplished by balancing the effect of the height H on blow back with that on the refill rate.

Referring again to FIG. 7, the volume of the ink being displaced by the bubble (measured in pL) of the ink during ejection for the four printheads described above is also plotted on the graph. The point at which the blow back line for a particular printhead crosses its respective drop flux line provides the time period for refilling the ink chamber of the printhead after ejection of an ink drop. The refill time period for the printhead that does not include a barrier strip is about 35 microseconds. The printhead including the 7 μm tall barrier structure (which achieved the lowest blow back) has a time period for refill of about 50 microseconds. On the other hand, the printhead including the 3 μm tall barrier structure (which achieved a reduced blow back, but not as reduced as the printheads having the 5 μm or the 7 μm tall barrier structures), had a time period of refill of about 30 microseconds, which is significantly smaller than that for both the printhead that does not have a barrier structure and the printhead having the 7 μm tall barrier structure. The printhead including the 5 μm tall barrier structure (which also achieved a reduced blow back, but not as reduced as the printhead having the 7 μm tall barrier structure), had a time period of refill of about 35 microseconds, which is about the same time period as achieved for the printhead that does not have a barrier structure.

In light of the foregoing disclosure, it is believed that the optimal height H of the barrier structure 24 for the printhead 10 according to embodiment(s) herein for an ejection of about 10 pL per ink drop ranges from about 3 μm to about 5 μm. However, it is contemplated as being within the purview of the present disclosure that other heights may be suitable for varying drop volumes of the individual ink drops. In other words, the height H of the barrier structure 24 is generally scalable to the drop volume of the ink drop. For example, in some instances it may be desirable to use shorter or taller barrier structures and, thus, barrier structures having a height H lower than 3 μm or larger than 5 μm may also be used herein for different ink drop volumes. For instance, a barrier structure having a height H of about 1 μm to about 2 μm may be desirable with a drop volume of about 2 pL, whereas a barrier structure having a height H of about 20 μm to about 30 μm may be desirable with a drop volume of about 100 pL. Further, a barrier structure having a height H that is less than 3 μm for a 10 pL ink drop may advantageously be used in systems ejecting inks that have higher viscosities (e.g., greater than about 3 cP at the operating temperature of the printhead 10), while a taller barrier structure (i.e., one having a height H that is larger than 5 μm for a 10 pL ink drop may be used in systems ejecting inks having lower viscosities (e.g., about 1 cP at the operating temperature of the printhead 10).

Figure 9:
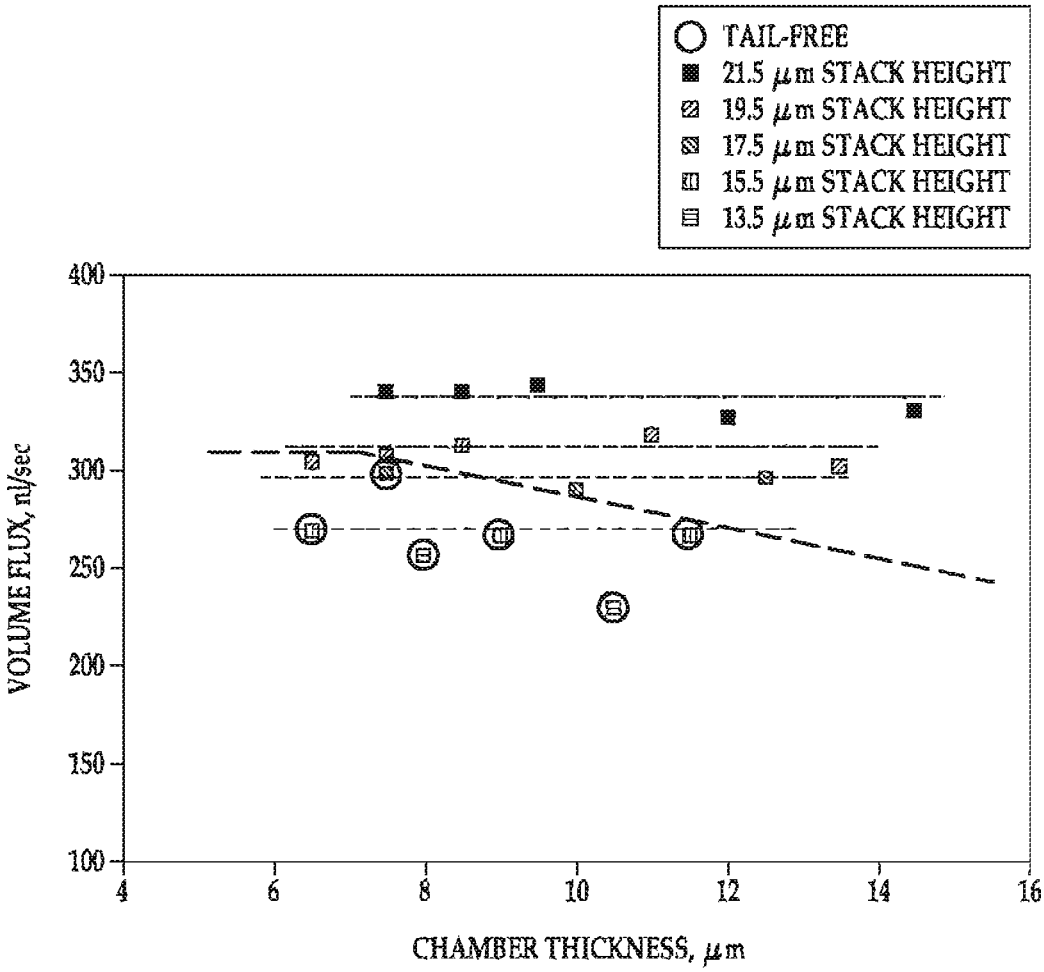
FIG. 9 is a graph showing the effect of the stack height and barrier height of the printhead on the refill rate, measured in terms of volume flux.

Additionally, the desired barrier height H may be determined based on the stack height (SH, as shown in FIG. 1) of the printhead 10. The stack height SH generally includes a chamber thickness (CT, also shown in FIG. 1) of section $S_2$ of the ink chamber 16, which is measured from the surface 30 of the substrate 12 to the inlet of the orifice 30 (which has the entrance diameter $D_1$). FIG. 9 provides a graph showing the effect of the chamber thickness CT on the refill rate (measured in terms of volume flux) for various stack heights SH using a 3 μm barrier structure 24. As shown in FIG. 9, the volume flux effectively formed substantially tail-free ink drops or ink drops having reduced tails in instances where the printhead 10 had a chamber thickness from about 6 μm to about 12 μm. Accordingly, the height H of the barrier structure 24 enabling an effective refill rate (with desired blow back) ranges from about 25% to about 50% of the chamber thickness CT.

Figure 8:
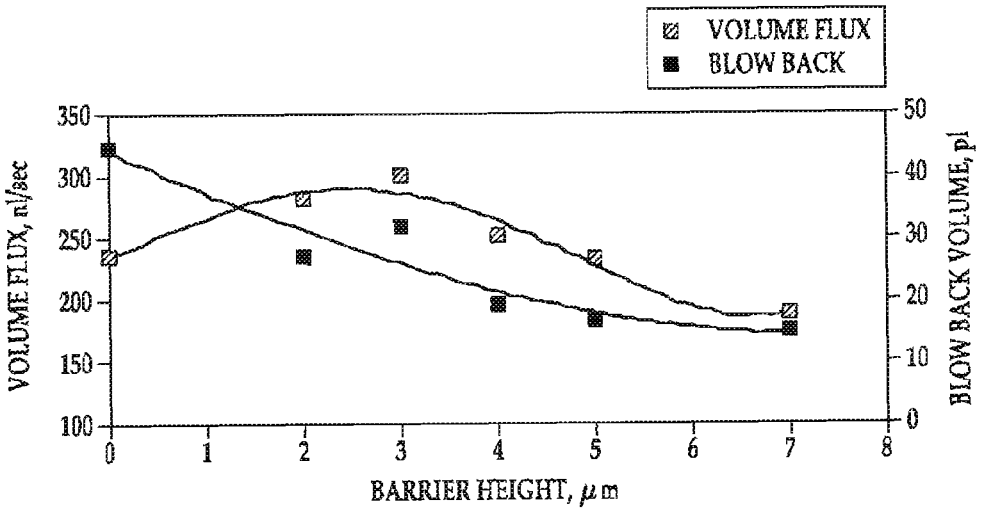
FIG. 8 is a graph showing the effect of the height of a barrier structure on the refill rate, measured in terms of volume flux.

Referring now to FIG. 8, a barrier structure having a height of about 3 μm produces the highest volume flux (defined as the drop volume times the firing frequency and measured in pL/sec) as compared to the other barrier structures, while still reducing the blow back volume (measured in pL). In a non-limiting example, refill rate (measured in terms of volume flux) ranges from about 100 nL/sec to about 450 nL/sec. As shown in FIG. 8, the refill rate for a 3 μm tall barrier structure is about 290 nL/sec, while the blow back is reduced to about 25 pL. Further, the refill rate of a printhead having a similar architecture, but without a barrier structure, is about 230 nL/sec. Although the blow back is actually lower for taller barrier structures, the volume flux significantly drops, indicating a drop in the refill rate.

Other embodiments of the barrier structure 24 that advantageously reduce blow back, yet increase refill rate are also contemplated herein. For example, it may be advantageous to provide a particle-tolerant structure as the barrier structure 24. In a non-limiting example, the particle-tolerant structure may include at least one gap or aperture defined in the solid barrier strips $\mathbf{24}_A$, $\mathbf{24}_B$. In another example, the barrier structure 24 (e.g., the barrier strips $\mathbf{24}_A$, $\mathbf{24}_B$) may also be angularly offset from the substrate 30. For instance, the barrier structure 24 may be tilted inwards toward the firing resistor 22 with up to about 45° of inclination. In yet another example, the barrier structure 24 (e.g., the barrier strips $\mathbf{24}_A$, $\mathbf{24}_B$) may be geometrically straight (as shown in FIGS. 1 and 2) or may have other shapes (curved, bent, rounded, etc.).

While several embodiments have been described in detail, it will be apparent to those skilled in the art that the disclosed embodiments may be modified. Therefore, the foregoing description is to be considered exemplary rather than limiting.

What is claimed is:

1. A printhead for use in an inkjet printing process, the printhead comprising:

a substrate having at least one ink feed opening defined therein;

a nozzle plate disposed on a portion of the substrate, the nozzle plate having a plurality of orifices defined therein;

an ink chamber in operative and fluid communication with the at least one ink feed opening;

a firing resistor disposed on an other portion of the substrate and proximate to the at least one ink feed opening and operatively associated with at least one of the plurality of orifices; and a barrier structure also disposed on the other portion of the substrate and positioned adjacent to the firing resistor, wherein the barrier structure includes a pair of substantially parallel barrier strips, each of the barrier strips extending across the substrate on a respective opposed side of the firing resistor, and no other barrier structure is disposed on the substrate between the pair of substantially parallel barrier strips.

2. The printhead as defined in claim 1 wherein: each of the barrier strips has a height extending outwardly from a surface of the substrate; the distance between the surface of the substrate and the entrance diameter of the orifice defines a chamber thickness; and the height of each of the barrier strips ranges from about 25% to about 50% of the chamber thickness.

3. The printhead as defined in claim 1 wherein the barrier structure is oblique to the substrate.

4. The printhead as defined in claim 1 wherein each of the pair of barrier strips is a continuous, solid structure.

5. The printhead as defined in claim 1 wherein each of the pair of barrier strips is a solid structure having at least one gap defined therein.

6. The printhead as defined in claim 1 wherein the barrier structure is configured to alter a profile of a bubble pressure of an ink ejection bubble formed when the firing resistor heats ink in the ink chamber, and the barrier structure is further configured to direct the bubble pressure towards the orifice, thereby i) reducing blow back of the ink back into the ink chamber after ejection, and ii) increasing a refill rate of the ink into the ink chamber for subsequent ink ejection.

7. The printhead as defined in claim 6 wherein the blow back ranges from about 10 pL to about 30 pL.

8. The printhead as defined in claim 6 wherein the pressure profile further enables the generation of i) an ink drop (I) having a reduced tail (T), or ii) a substantially tail-free ink drop.

9. The printhead as defined in claim 1 wherein the printhead is configured to be used in a clear mode firing operation.

10. A method of generating ink drops having reduced tails during an inkjet printing process, the method comprising:

providing a printhead of claim 1;

ejecting an ink drop through the orifice of the nozzle plate by generating an ejection bubble of ink in the ink chamber as a result of localized heating of the ink by the firing resistor, the ejection bubble pushing a portion of the ink through the orifice; and altering, via the barrier structure, a profile of a bubble pressure of the ejection bubble during the ejection of the ink.

11. The method as defined in claim 10 wherein the altering of the pressure profile of the ejection bubble i) reduces blow back of the ink back into the ink chamber after ejection, and ii) increases a refill rate of the ink into the ink chamber for subsequent ejection.

12. The method as defined in claim 10 wherein the altering of the pressure profile includes directing a portion of the bubble pressure towards the orifice.

13. The method as defined in claim 10 wherein the barrier structure includes a pair of substantially parallel barrier strips, each of the barrier strips extending across the substrate on a respective opposed side of the firing resistor.

14. The method as defined in claim 10 wherein each of the barrier strips has a height, extending outwardly from a surface of the substrate, ranging from about 3 μm to about 5 μm for a drop volume of about 10 pL, and wherein a refill rate ranges from about 100 pL/sec to about 450 pL/sec.

* * * * *